United States Patent [19]

Strahan

[11] 4,244,114

[45] Jan. 13, 1981

[54] STEPPED PLATFORM RAMP SIGHT FOR FIREARMS

[76] Inventor: Travis R. Strahan, Rte. 7, Townsend Cir., Ringgold, Ga. 30736

[21] Appl. No.: 85,778

[22] Filed: Oct. 17, 1979

Related U.S. Application Data

[63] Continuation-in-part of Ser. No. 974,053, Dec. 28, 1978, Pat. No. 4,192,075.

[51] Int. Cl.[3] ..... F41G 1/02

[52] U.S. Cl. ..... 33/257; 33/233; 42/1 S

[58] Field of Search ..... 33/233, 243, 252, 257, 33/258, 242, 260, 241; 42/1

[56] References Cited

U.S. PATENT DOCUMENTS

| | | | |
|---|---|---|---|
| 2,484,368 | 10/1949 | Young | 33/252 |
| 4,130,958 | 12/1978 | Gutridge | 33/243 |
| 4,192,075 | 3/1980 | Strahan | 33/233 |

*Primary Examiner*—William D. Martin, Jr.
*Attorney, Agent, or Firm*—Alan Ruderman

[57] ABSTRACT

A target sight for handguns includes a rear notched rib sight and a stepped front ramp sight together on a platform. The ramp includes a series of steps extending from the front of the sight platform rearwardly to adjacent the rear sight. The platform is mounted on a base member which is secured to the gun. The mounting of the platform on the base includes a pivotable mounting so that the platform may be adjusted vertically and laterally relatively to the base and the gun.

10 Claims, 4 Drawing Figures

STEPPED PLATFORM RAMP SIGHT FOR FIREARMS

CROSS-REFERENCE TO RELATED APPLICATIONS

This is a continuation-in-part of copending U.S. Pat. application No. 974,053 filed Dec. 28, 1978 now U.S. Pat. No. 4,192,075.

BACKGROUND OF THE INVENTION

This invention relates to firearms and more particularly to an improved target aiming sight, especially for handguns.

In the known modern guns the sighting of a target makes use of a blade type front sight located at the front of the gun barrel and a notch type rear sight in a rectangular rib located behind the barrel on the barrel supporting frame. The blade is a small upstanding tab or a small angular tab, which, when sighting a target, is laterally aligned within the notch and vertically aligned so that the top of the blade is level with the top of the rectangular rib. When firing a gun having this type of sight, and especially when rapidly firing a revolver, difficulty is experienced in aligning the front and rear sights and maintaining the alignment for more than a very short period. This militates against accurate firing of a gun, which reduces marksmanship and thus the scores of a competitive marksman.

In the aforementioned copending patent application a significant improvement is provided by a gunsight which has a tapered ramp extending from the front of the sight above the front of the gun barrel rearwardly to adjacent the rear notched sight. The ramp is tapered from a maximum elevation at the front to a minimum elevation at the rear terminous which is below the notch of the rear sight.

Moreover, the known customized sights include means for adjusting either the rear sight or both sights to compensate for distance, elevation and windage. These known adjustable sights, however, are small independent elements mounted on a sighting base and are adjustable relatively to one another. Because of the mounting, there is a high degree of vertical, and in some cases also horizontal play in the sights. Also because of their independance of one another when one is accidently moved relative to the other the accuracy of the sight is impaired.

The aforesaid application mounts the front and rear sight on a common platform which is adjustable vertically and laterally relatively to the gun barrel.

SUMMARY OF THE INVENTION

The present invention provides an improved gunsight which is easily and quickly aligned to sight a target with great accuracy. The rear sight includes a notched rib and the front sight comprises a stepped tapered ramp extending from the front of the sight above the front of the gun barrel a substantial distance toward the rear sight and preferably proximate the rear sight. The ramp has a series of discrete steps extending substantially the length of the ramp and preferably at least to the point where the sight line with the bottom of the notch intersects the ramp. Thus, one sighting through the rear sight sees a series of ridges along the ramp leading to the front of the ramp. The steps effect deflection or refraction of the light striking the sighting path and eliminate washout of the front of the sight, washout being that condition where reflected light causes a reduced clarity of the front sight. Preferably the steps may be undercut slightly to further deflect the light and provide a shadowing effect along the ramp. Moreover, the first step may be more elevated relatively to the second step then are the other steps relatively to their adjacent steps.

With this arrangement the marksman will sight through the rear sight notch and align along the ramp to the top most portion at the front thereof until the target is properly sighted. The clarity of the front of the sight while aiming is exeptional since washout is substantially eliminated. Moreover, the sighting of a target is exceptionally rapid since the ramp orients the eye to the target and it can be maintained without distraction for substantially long periods. The deflection of the light provided by the steps provides exceptional clarity to the front sight resulting in increased marksmanship.

The front and rear sights may be positioned on, and preferably integral with, a platform positioned on a base member. The platform may be pivotably mounted on the base as in the aforesaid copending application so that the platform may be adjustable both vertically and laterally relatively to the base member. This construction provides a rigid, adjustable and accurate sight.

Consequently, it is a primary object of the present invention to provide a target sight for hand held firearms which is easily oriented and aligned to a target with great accuracy.

Another object of the invention is to provide a target gunsight having an elongated tapered front sight ramp extending step-wise along the ramp.

A further object of this invention is to provide a target sight having a front sight comprising an elongated ramp having a multiplicity of steps mounted on a platform, the platform adapted to be mounted on a gun for movement vertically and laterally relatively to the gun.

A still further object of this invention is the provision of an elongated stepped ramp sight mounted on a common platform with a notched rear sight, the front sight ramp extending rearwardly to adjacent the rear sight, and the platform being mounted on a base member for vertical and lateral adjustment relatively thereto.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
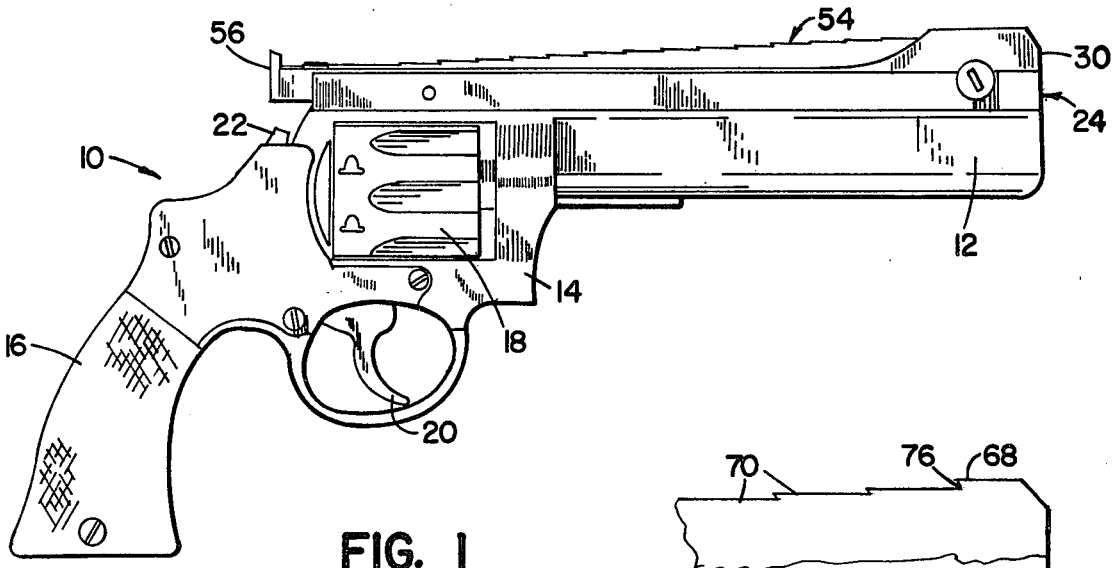
FIG. 1 is an elevational view of a gun embodying a gunsight incorporating the principles of the present invention.

Referring now to the drawings, FIG. 1 illustrates the preferred embodiment of the invention as applied to a revolver type handgun 10 having a barrel 12 secured to a frame 14. The gun, which includes a hand grip or handle 16, a cartridge cylinder 18, a firing mechanism including a trigger device 20 and a hammer 22, is conventional and forms no part of the present invention. The gunsight comprises a base member 24, with an arcurately shaped bottom surface 25, which may be secured to the barrel 12 and frame 14 by conventional means such as set screws 26 passing through holes 28 in the base member and threaded into corresponding holes (not illustrated) in the barrel and frame, and a sight platform 30 mounted on the base member as hereinafter described. Although the invention is shown and described with regard to a re /olver, the term hand-held gun is more generic and includes shotguns and rifles.

Figure 3:
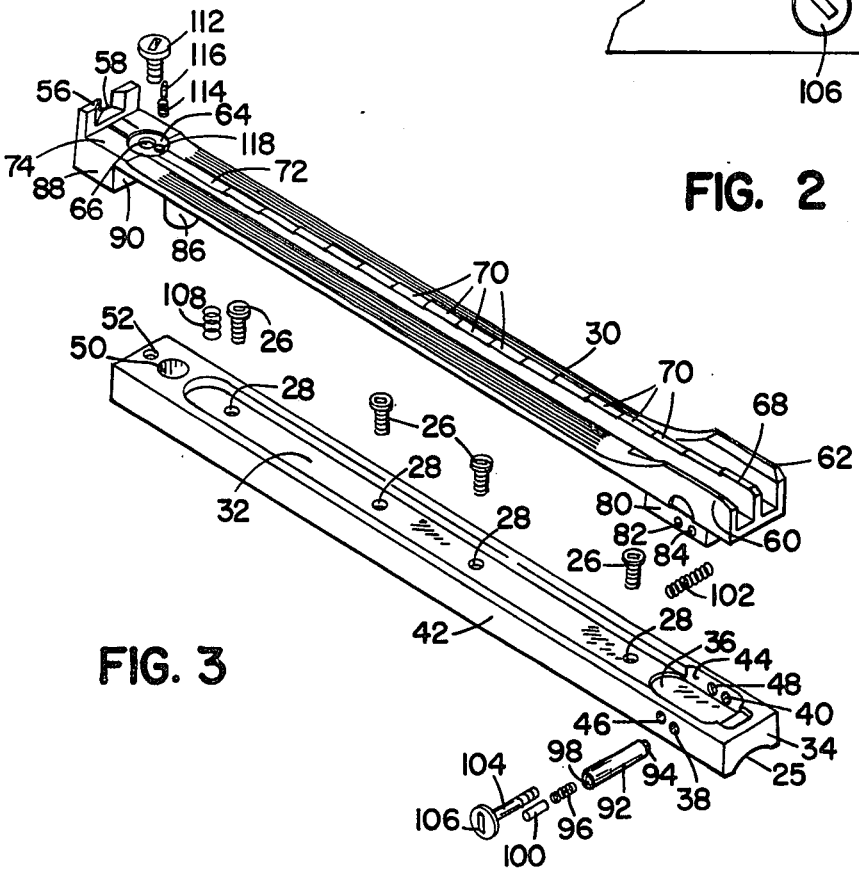
FIG. 3 is a disassembled perspective view of the gunsight illustrating the manner of mounting the sight platform on a base.
Figure 4:
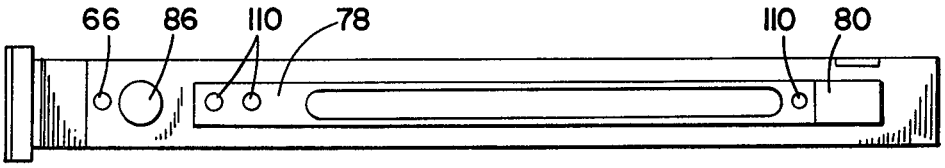
FIG. 4 is a bottom plan view of the gunsight platform in plan.

The base member 24, as illustrated in FIG. 3 comprises a substantially rectangular body having a longitudinal recess 32 formed therein and extending from adjacent the front end 34 for a substantial portion of the length of the base toward but spaced from the rear end. A small, but preferably deeper recessed portion 36 is formed slightly behind the leading portion of the recess 32 and includes a pair of laterally aligned spaced holes 38 and 40 in the respective side walls 42 and 44 of the base member, the hole 40 being slightly smaller than 38. Another hole 46 is formed in the side wall 42 adjacent the hole 38 while an aligned socket 48 is formed in the wall 44 adjacent the hole 40. Formed vertically in the rear of the base member behind the recess 32 are two longitudinally spaced holes 50, and 52, the hole 52 being a small threaded hole.

The sight platform 30 comprises an elongated member having an upstanding front sight ramp 54 longitudinally extending from the front edge of the platform rearwardly, and substantially centrally located laterally. The rear of the platform has an upstanding rib 56 including a centrally disposed notch 58. Preferably, the ramp 54 extends from the front edge of the platform between a pair of fences 60,62 to adjacent the front of the rib and below the bottom edge of the notch or at least to the point where the line of sight with the bottom of the notch intersects the ramp. As illustrated the ramp terminates at the periphery of a counterbore 64 about a hole 66. The lateral thickness of the ramp 54 should be approximately equal to the lateral width of the notch 58 for good aiming results. The ramp 54 has its maximum elevation just behind the leading edge, which may have a slight inclination as illustrated, and thereafter extends incrementally rearwardly as a series of discrete steps 68 and 70; 68 illustrating the initial step and 70 being illustrative of the remaining steps except for the final step 72 which may be at substantially at the same level as the rear surface 74 of the platform and below the notch. As illustrated, each step includes a discrete rest surface and a riser.

Figure 2:
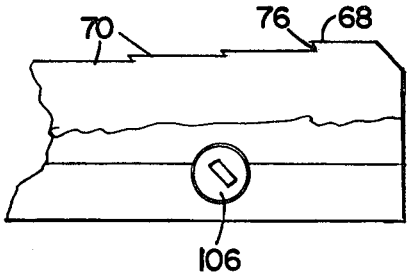
FIG. 2 is an enlarged fragmented elevational view of the front portion of the sight illustrated in FIG. 1 partly broken away.

The steps act to deflect and or refract the light striking the front sight and substantially eliminates the washout effect. As best illustrated in FIG. 2, the steps preferably may be undercut from the rear edge forwardly such as at riser 76 to provide a shadowing effect. In the preferred form an undercut angle of approximately 65 degrees has been found to provide excellent results, although it would appear that as long as the angle is less than 90 degrees from the vertical similar results should be obtainable. The initial step 68 preferably may be vertically spaced above the second step by a greater amount than the vertical spacing between the other steps to provide a post effect. Thus, when sighting through the rear notch the initial step 68 clearly stands out relatively to the other steps 70 which appear as a series of ridges. In the preferred form the riser of the initial step is approximately 0.050 inch while the other steps they are approximately 0.016 to 0.018 inch.

The bottom of the platform includes a depending rib 78 which, when the platform is positioned on the base member 24 is positioned within the recess 32. A lug 80 depends downwardly from the leading edge of the rib 78 and is positioned within the deeper recess 36. A pair of bores 82 and 84 are formed in the lug 80, the bore 82 being threaded. The bore 82 is aligned with the holes 38 and 40 when the sight is assembled, and the bore 84 is aligned with the bore 46 and socket 48. The bottom of the platform also includes a downwardly depending stud pin 86, which is received in the hole 50 in the base member, and a depending block 88 having a face 90 spaced from the stud 86 positioned adjacent the rear end of the base.

When the platform is assembled to the base a pin 92 having a reduced end portion 94 is positioned in the hole 38 with the end 94 in the smaller hole 40. A spring 96 is received within an axial bore 98 in the pin 92 and a smaller pin 100 is inserted after the spring. Another spring 102 is positioned in the recess 36 axially with the hole 46 and socket 48, and an adjusting screw 104 is received within the coils of the spring 102 and is threaded into the bore 82. The rear of the head 106 of screw 104 has a number of detents which selectively engage the pin 100 when assembled so that the platform can be adjusted laterally relative to the base member as it pivots about the stud pin 86, the springs 102 and 96 providing positive tension for fine adjustments with defined steps. One or more additional springs 108 may be positioned within recesses 110 in the rib 78 to provide an upward bias against the platform which is countered by another adjusting screw 112 received through the hole 66 and threaded into the hole 52 in the base for vertical adjustment of the platform relatively to the base about the pin 92. A positive tension detent may be provided for the screw 112 by a small spring 114 and pin 116 received in a hole 118 in the counterbore 64 for fine lateral adjustment of the platform relatively to the base.

When the sight is mounted on the gun the front of the ramp is located above the front of the gun barrel and the marksman aligns through the notch 58 along the ramp to the front step 68. The eye of the marksman can quickly sight along the ramp and jump to the step 68, and can maintain this alignment for extended periods. Since there is virtually no washout of the front sight and thus no distractions, exceptional accuracy can be obtained.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed is:

1. A target sight for hand-held firearms having a gun barrel and a frame to which the barrel is secured, said target sight comprising a rear sight upstanding rib member having a notch formed therein positioned above the frame of the gun rearwardly of the barrel, and a front sight member, said front sight member comprising an elongated ramp laterally aligned with said notch positioned above the barrel at the front thereof and extending rearwardly toward said rear sight, said ramp comprising a series of discrete steps descending from a maximum elevation at the front to a minimum elevation at the rear, each step comprising a substantially flat rearwardly extending rest surface, and a riser connecting adjacent steps, said rest surfaces being dimensionally elongated relatively to said risers.

2. A target sight as recited in claim 1 wherein said ramp extends rearwardly of the barrel to adjacent said rear sight.

3. A target sight as recited in claim 1 wherein said ramp extends rearwardly to at least the elevation of the bottom of said notch.

4. A target sight as recited in claim 1, wherein each step is undercut forwardly relatively to the frontwardly adjacent step.

5. A target sight for hand-held firearms as recited in claim 1, wherein the most frontward step is elevationally spaced above its adjacent rearward step by a distance greater than the elevational spacing between the other steps.

6. A target sight for hand-held firearms as recited in claim 1, wherein said front and rear sight are integrally carried on a platform.

7. A target sight as recited in claim 1, wherein said front and rear sights are carried on a platform, and including a base member adapted to be secured to the gun barrel frame, and means for adjustably attaching said platform to said base member for selective movement of said platform relatively to said base member.

8. A target sight as recited in claim 7, wherein said means includes journal means for pivotably mounting said platform for limited movement in a lateral plane, and adjusting means for selectively moving said platform in said plane about said journal means.

9. A target sight as recited in claim 8, wherein said journal means comprises a stud pin on the underside of said platform extending substantially normal to said lateral plane, and an aperture in said base for journally receiving said pin for relative turning therebetween.

10. A target sight for hand-held firearms as recited in claim 3, wherein said front and rear sights are carried on a platform, and including a base member adapted to be secured to the gun barrel frame, and means for adjustably attaching said platform to said base member for selective movement of said platform relatively to said base member.

* * * * *